US008178772B2

(12) United States Patent
Iwase

(10) Patent No.: US 8,178,772 B2
(45) Date of Patent: May 15, 2012

(54) RESONANCE SOUND ADDING APPARATUS FOR KEYBOARD INSTRUMENT

(75) Inventor: Hiroshi Iwase, Akishima (JP)

(73) Assignee: Casio Computer Co., Ltd., Tokyo (JP)

( * ) Notice: Subject to any disclaimer, the term of this patent is extended or adjusted under 35 U.S.C. 154(b) by 298 days.

(21) Appl. No.: 12/183,280

(22) Filed: Jul. 31, 2008

(65) Prior Publication Data

US 2009/0031886 A1 Feb. 5, 2009

(30) Foreign Application Priority Data

Aug. 1, 2007 (JP) ..... 2007-200373

(51) Int. Cl.
*G10H 1/02* (2006.01)

(52) U.S. Cl. ..... 84/661; 84/627; 84/633

(58) Field of Classification Search ..... 84/661
See application file for complete search history.

(56) References Cited

U.S. PATENT DOCUMENTS 4,175,463 A * 11/1979 Deutsch ..... 84/624
5,352,849 A * 10/1994 Kobayashi ..... 84/659
5,648,629 A * 7/1997 Kozuki ..... 84/660
RE35,813 E * 6/1998 Usa et al. ..... 84/606

FOREIGN PATENT DOCUMENTS

JP 5-80749 A 4/1993
JP 6-149245 A 5/1994
JP 2002-311957 A 10/2002

* cited by examiner

*Primary Examiner* — Elvin G Enad
*Assistant Examiner* — Christopher Uhlir
(74) *Attorney, Agent, or Firm* — Holtz, Holtz, Goodman & Chick, PC

(57) ABSTRACT

Resonators generate resonance sound data of given resonant frequencies based on sound signal data corresponding to a pitch of a key. Each resonator includes a delay circuit which delays an input based on delay time data, a second adder which adds an output from the delay circuit to input sound signal data, and a low-pass filter which performs filtering depending on a filter control signal on the output from the second adder. An output from the low-pass filter is input to the delay circuit, and a first adder adds outputs from the resonators. A storage device stores a coefficient table containing items of delay time data to be provided to the resonators, and the items of the delay time data do not match with frequencies corresponding to pitches of keys.

9 Claims, 13 Drawing Sheets

FIG.4A

401

| | FREQUENCY (Hz) | CYCLE (msec) |
|---|---|---|
| C3 | 130.82 | 7.644 |
| C#3 | 138.59 | 7.216 |
| D3 | 146.83 | 6.810 |
| D#3 | 155.57 | 6.428 |
| E3 | 164.82 | 6.067 |
| F3 | 174.62 | 5.727 |
| F#3 | 185.00 | 5.406 |
| G3 | 196.00 | 5.102 |
| G#3 | 207.65 | 4.816 |
| A3 | 220.00 | 4.545 |
| A#3 | 233.08 | 4.290 |
| B3 | 246.94 | 4.050 |

FIG.4B

402

| | FREQUENCY (Hz) | CYCLE (msec) |
|---|---|---|
| C4 | 261.63 | 3.822 |
| C#4 | 277.18 | 3.608 |
| D4 | 293.66 | 3.405 |
| D#4 | 311.13 | 3.214 |
| E4 | 329.63 | 3.034 |
| F4 | 349.23 | 2.863 |
| F#4 | 369.99 | 2.703 |
| G4 | 392.00 | 2.551 |
| G#4 | 415.30 | 2.408 |
| A4 | 440.00 | 2.273 |
| A#4 | 466.16 | 2.145 |
| B4 | 493.88 | 2.025 |

FIG.5A

501

| | DELAY TIME (msec) |
|---|---|
| C3-C#3 | 7.242 |
| C#3-D3 | 7.008 |
| D3-D#3 | 6.614 |
| D#3-E3 | 6.242 |
| E3-F3 | 5.893 |
| F3-F#3 | 5.562 |
| F#3-G3 | 5.250 |
| G3-G#3 | 4.954 |
| G#3-A3 | 4.676 |
| A3-A#3 | 4.414 |
| A#3-B3 | 4.116 |
| B3-C4 | 3.932 |

FIG.5B

502

| | DELAY TIME (msec) |
|---|---|
| C4-C#4 | 3.712 |
| C#4-D4 | 3.504 |
| D4-D#4 | 3.307 |
| D#4-E4 | 3.121 |
| E4-F4 | 2.946 |
| F4-F#4 | 2.781 |
| F#4-G4 | 2.625 |
| G4-G#4 | 2.477 |
| G#4-A4 | 2.338 |
| A4-A#4 | 2.207 |
| A#4-B4 | 2.083 |
| B4-C5 | 1.966 |

FIG.6A

601

| | DELAY TIME (msec) |
|---|---|
| DL1 | 7.008 |
| DL2 | 6.242 |
| DL3 | 5.562 |
| DL4 | 4.954 |
| DL5 | 4.414 |

FIG.6B

602

| | DELAY TIME (msec) |
|---|---|
| DR1 | 3.504 |
| DR2 | 3.121 |
| DR3 | 2.781 |
| DR4 | 2.477 |
| DR5 | 2.207 |

FIG.7

701

| DAMPER LEVEL | FILTER CONTROL DATA (CUTOFF FREQUENCY: KHz) |
|---|---|
| 0 | 1 |
| 1 | 1.0315 |
| 2 | 1.0630 |
| 3 | 1.0945 |
| ⋮ | ⋮ |
| 126 | 4.9685 |
| 127 | 5 |

FIG.8A

| | FREQUENCY (Hz) | CYCLE (msec) |
|---|---|---|
| C4 | 267.57 | 3.737 |
| C♯4 | 283.48 | 3.528 |
| D4 | 300.34 | 3.330 |
| D♯4 | 318.20 | 3.143 |
| E4 | 337.12 | 2.966 |
| F4 | 357.17 | 2.800 |
| F♯4 | 378.40 | 2.643 |
| G4 | 400.90 | 2.494 |
| G♯4 | 424.74 | 2.354 |
| A4 | 450.00 | 2.222 |
| A♯4 | 476.76 | 2.097 |
| B4 | 505.11 | 1.980 |

FIG.8B

| | DELAY TIME (msec) | |
|---|---|---|
| C4-C♯4 | 3.629 | |
| C♯4-D4 | 3.426 | 811 |
| D4-D♯4 | 3.233 | |
| D♯4-E4 | 3.052 | 812 |
| E4-F4 | 2.881 | |
| F4-F♯4 | 2.719 | 813 |
| F♯4-G4 | 2.566 | |
| G4-G♯4 | 2.422 | 814 |
| G♯4-A4 | 2.286 | |
| A4-A♯4 | 2.158 | 815 |
| A♯4-B4 | 2.037 | |
| B4-C5 | 1.923 | |

FIG.13

1300

| | | TONALITY | | | | | | | |
|---|---|---|---|---|---|---|---|---|---|
| | DELAY TIME (msec) | ····· | B♭(Gm) | F (Dm) | C (Am) | G (Em) | A (F♯m) | E (C♯m) | ····· |
| DL1 | 7.242 | ····· | ○ | ○ | ○ | × | × | × | ····· |
| DL2 | 7.008 | ····· | × | × | × | × | ○ | ○ | ····· |
| DL3 | 6.614 | ····· | ○ | ○ | ○ | ○ | × | × | ····· |
| DL4 | 6.242 | ····· | × | × | × | × | × | × | ····· |
| DL5 | 5.893 | ····· | × | × | ○ | ○ | ○ | ○ | ····· |
| DL6 | 5.562 | ····· | ○ | ○ | × | × | × | × | ····· |
| DL7 | 2.250 | ····· | × | × | × | × | ○ | ○ | ····· |
| DL8 | 4.954 | ····· | ○ | ○ | ○ | ○ | × | × | ····· |
| DL9 | 4.676 | ····· | × | × | × | × | × | ○ | ····· |
| DL10 | 4.414 | ····· | × | ○ | ○ | ○ | ○ | × | ····· |
| DL11 | 4.116 | ····· | ○ | × | × | × | × | × | ····· |
| DL12 | 3.932 | ····· | × | × | × | ○ | ○ | ○ | ····· |

1301 1302

RESONANCE SOUND ADDING APPARATUS FOR KEYBOARD INSTRUMENT

CROSS-REFERENCE TO RELATED APPLICATIONS

This application is based upon and claims the benefit of priority from prior Japanese Patent Application No. 2001-200373, filed Aug. 1, 2007, the entire contents of which are incorporated herein by reference.

BACKGROUND OF THE INVENTION

1. Field of the Invention

The present invention relates to a resonance sound adding apparatus for a keyboard instrument.

2. Description of the Related Art

In an acoustic piano, a string which is struck by a hammer of a keyboard resonates with a string of another tone in a state in which a damper pedal is pressed and damping of strings is released. By way of example, an electronic piano has functions of generating a resonance sound which imitates a resonant state between strings of the acoustic piano, adding the generated resonance sound to the sound having a pitch of a pressed key, and outputting resulting sound.

Jpn. Pat. Appln. KOKAI Publication No. 06-149245 discloses an apparatus that, in response to pressing of a damper pedal, changes an envelope for direct sound and an envelope for resonance sound, and changes sound volume. The envelope for the direct sound is attached to a waveform of a direct sound and the envelope for resonance sound is attached to a waveform of a resonance sound, which a musical sound corresponding to a state in which the damper pedal is pressed is generated.

Further, an apparatus for generating resonance data of sound signal data is disclosed in Jpn. Pat. Appln. KOKAI Publication No. 2002-311957. The apparatus includes a plurality of delay units coupled in series, provides a resonance coefficient to the respective delay units, and multiplies delayed musical signal data by a delay coefficient to generate the resonance data.

Furthermore, it has been proposed an apparatus that, when a pedal other than a damper pedal is pressed, generates a musical sound containing the pedal effect. For example, Jpn. Pat. Appln. KOKAI Publication No. 05-80749 discloses an apparatus that includes first to third groups of sound sources and a group of not-struck-string sound sources. The sound sources of the first to third groups store sound data of struck strings. The not-struck-string sound sources store sound data of strings which are not struck. When a shift pedal is pressed, the apparatus reads data from the group of not-struck-string sound sources in place of the second and third groups of sound sources and also changes filtering characteristics, thereby generating a musical sound containing a shift pedal effect.

However, the above techniques disclosed in Jpn. Pat. Appln. KOKAI Publication No. 06-149245 and Jpn. Pat. Appln. KOKAI Publication No. 05-80749 need to store a large amount of data to provide sound sources for generating the pedal effect (e.g., for storing waveform data of a resonance sound or sound data of not struck strings).

In the apparatus disclosed in Jpn. Pat. Appln. KOKAI Publication No. 2002-311957 does not require another sound source for a resonance sound because resonance data of a specific resonant frequency is generated based on original sound signal data, and the generated resonance data is attached to the original sound signal data.

Hereinafter a device that produces a resonance sound of one resonant frequency will be referred to as a resonator. In the case where as many resonators as the number of keys or the number of strings including sub-strings are provided, respective resonance intensities can be appropriately controlled in such a manner that respective resonators generate items of resonance data based on resonant frequencies of the respective strings.

However, the number of resonators which can be provided has a limit. Therefore, an intensity of a resonance sound varies depending on a pitch of a musical sound to be generated, and a resonance sound of a specific resonant frequency at a specific pitch is emphasized. As a result, a harsh resonance is generated.

BRIEF SUMMARY OF THE INVENTION

According to an embodiment of the present invention, a resonance sound adding apparatus for a keyboard instrument comprises:

a resonator group comprising resonators and a first adder, the resonators generating resonance sound data of given resonant frequencies based on sound signal data corresponding to a pitch of a key which is struck, each of the resonators including a delay circuit configured to delay an input based on delay time data indicating a delay time, a second adder configured to add an output from the delay circuit to input sound signal data, and a first low-pass filter configured to receive an output from the second adder and to perform low-pass filtering by a cutoff frequency depending on a filter control signal on the output from the second adder, and an output from the first low-pass filter inputting to the delay circuit, and the first adder adding outputs from the resonators;

a third adder configured to add the sound signal data and an output from the resonator group;

a storage device configured to store a coefficient table containing items of delay time data to be provided to each of the resonators; and a delay controller configured to read different items of the delay time data from the coefficient table and supply the different items of the delay time data to the resonators;

wherein the items of the delay time data do not match with frequencies corresponding to pitches of keys of the keyboard instrument.

BRIEF DESCRIPTION OF THE SEVERAL VIEWS OF THE DRAWING

The accompanying drawings, which are incorporated in and constitute a part of the specification, illustrate embodiments of the present invention and, together with the general description given above and the detailed description of the embodiments given below, serve to explain the principles of the present invention in which:

FIGS. 4A and 4B are views showing frequencies of given keys when a key A4 corresponds to a frequency of 440 Hz;

FIGS. 5A and 5B are views showing an example of coefficient tables according to the embodiment;

FIGS. 6A and 6B are views showing another example of the coefficient tables according to the embodiment;

FIG. 7 is a view showing an example of a filter control data table according to the embodiment;

FIG. 8A is a view showing frequencies of given keys when a key A4 corresponds to a frequency of 450 Hz;

FIG. 8B is a view showing frequencies (delay times) corresponding to inverse numbers of intermediates pitches between pitches shown in FIG. 8A and adjacent pitches;

FIG. 13 is a view for explaining a coefficient table and a coefficient selection table for a resonance sound adding device according to a forth embodiment.

DETAILED DESCRIPTION OF THE INVENTION

Figure 1:
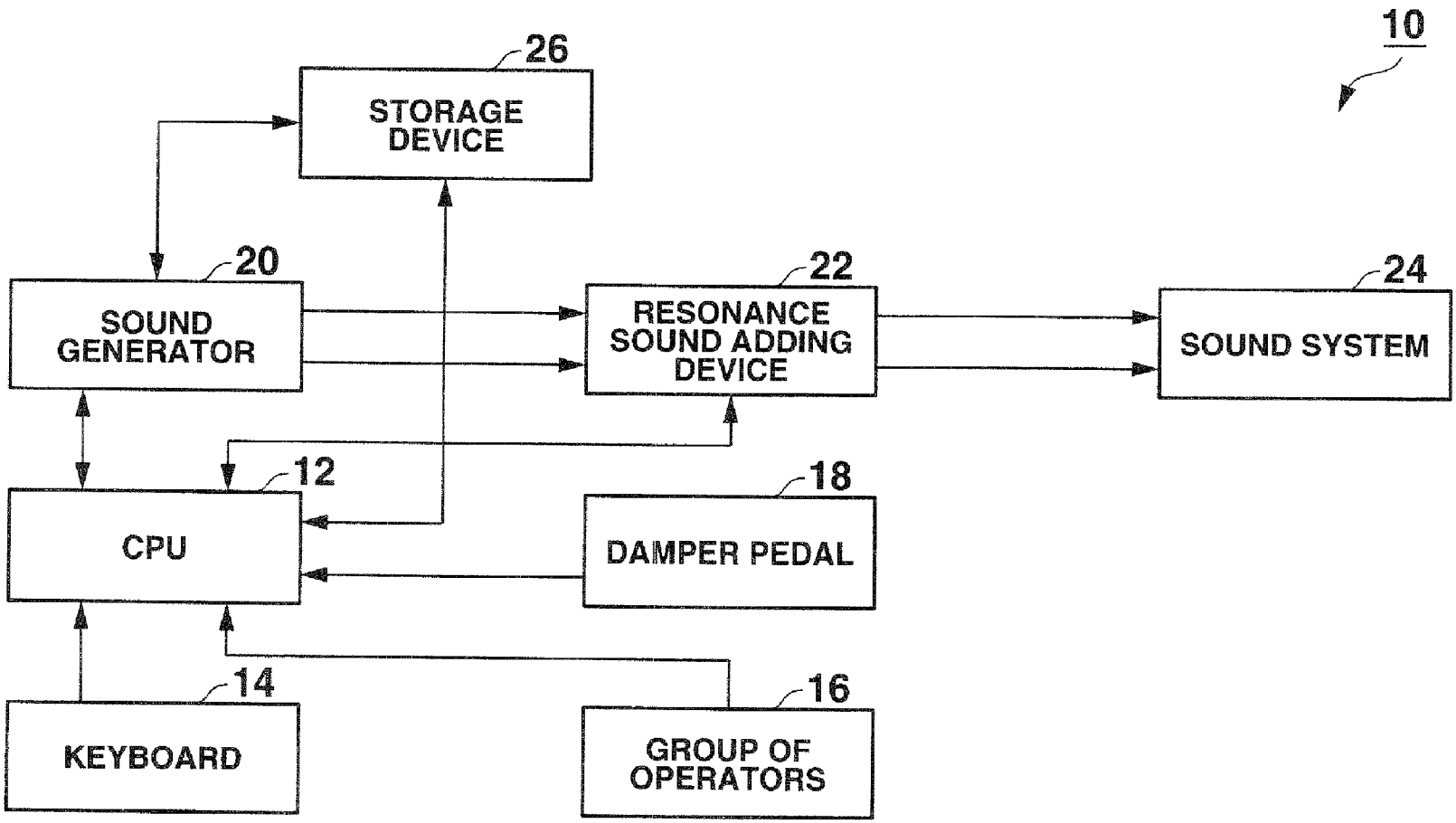
FIG. 1 is a block diagram showing a configuration of a keyboard instrument including a resonance sound adding device according to an embodiment of the invention.

Embodiments according to the present invention will now be explained with reference to the accompanying drawings. FIG. 1 is a block diagram showing a configuration of a keyboard instrument including a resonance sound adding device according to an embodiment of the present invention. As shown in FIG. 1, a keyboard instrument 10 according to the present embodiment includes a CPU 12, a keyboard 14, a group of operation members 16 which includes a switch, a damper pedal 18, a sound generator 20, a resonance sound adding device 22, a sound system 24, and a storage device 26.

The CPU 12 executes control over the entire keyboard instrument 10. The CPU 12 also executes detection of key pressing operation of the keyboard 14 and operation of the group of operation members 16. Moreover, the CPU 12 executes detection of on or off state of the damper pedal 18 and also a pressing extent of the damper pedal 18. The CPU 12 further executes control over the sound generator 20 and the resonance sound adding device 22 based on results of the above detections. When tuning of a musical sound to be generated is changed in response to an operation of any of the operation members, the CPU 12 calculates values to be stored in a coefficient table in the storage device 26.

The CPU 12 can detect riot only on or off state of the damper pedal 18 but also the degree of pressing (damper level) of the damper pedal 18. For example, the CPU 12 can detect a state of the pressed damper pedal (degree of damping) by 128 levels (0 [damper pedal off] to 127 [damper pedal fully on]).

Upon receiving pitch information of a struck key from the CPU 12, the sound generator 20 reads waveform data from a waveform memory in the storage device 26, and generates and outputs sound signal data of the pitch of the struck key. In the present embodiment, sound signal data is output in two systems, i.e., right and left channels.

The resonance sound adding device 22 receives the sound signal data, generates data of a resonance sound (resonance data) based on the sound signal data, and adds the generated resonance data to the sound signal data.

The sound system 24 includes an amplifier and a speaker. The sound system 24 outputs an acoustic signal based on the sound signal data with the resonance sound attached thereto.

Figure 2:
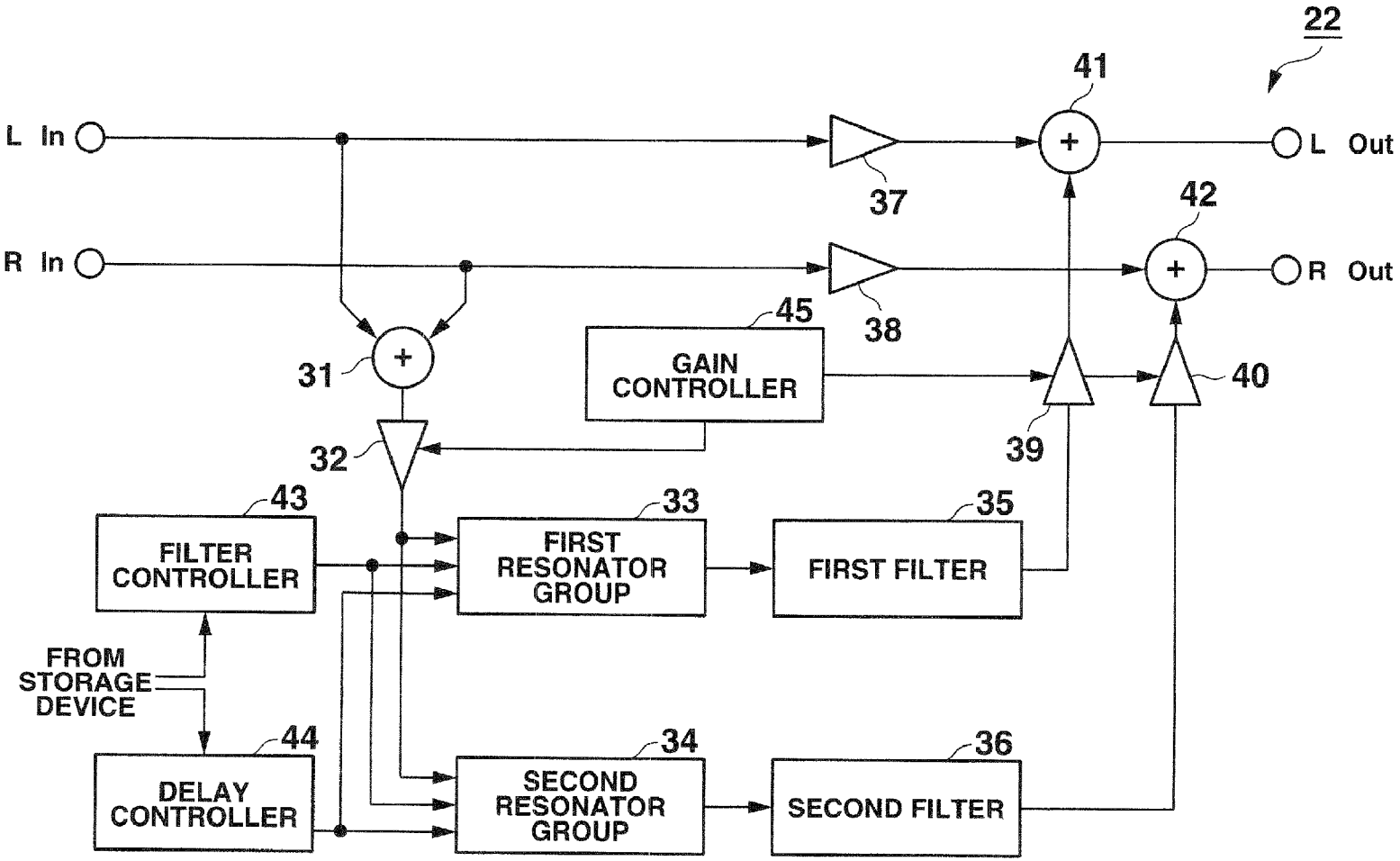
FIG. 2 is a block diagram showing a configuration of the resonance sound adding device according to the embodiment.

FIG. 2 is a block diagram showing a configuration of the resonance sound adding device according to the present embodiment. The resonance sound adding device 22 according to the present embodiment includes an adder 31, an amplifier 32, a first resonator group 33 and a second resonator group 34, first and second filters 35 and 36, amplifiers 37, 38, 39 and 40, and adders 41 and 42. The adder 31 adds sound signal data L_In of a left channel (L. ch) and sound signal data R_In of a right channel (R. ch). The amplifier 32 amplifies an output from the adder 31 based on a gain control signal from a gain controller 45. The first resonator group 33 generates first resonance data for the left channel and the second resonator group 34 generates second resonance data for the right channel. The first filter 35 filters the first resonance data output from the first resonator group 33, and the second filter 36 filters the second resonance data output from the second resonator group 34. The amplifier 37 amplifies the sound signal data of the left channel, and the amplifier 38 amplifies the sound signal data of the right channel. The amplifier 39 amplifies an output from the first filter 35 in accordance with a gain control signal from the gain controller 45, and the amplifier 40 amplifies an output from the second filter 36 in accordance with a gain control signal from the gain controller 45. The adder 41 adds an output from the amplifier 37 to an output from the amplifier 39, and sound signal data L_Out of the left channel containing a resonance sound is output. The adder 42 adds an output from the amplifier 38 to an output from the amplifier 40, and sound signal data R_Out of the right channel containing a resonance sound is output.

The resonance sound adding device 22 also includes a filter controller 43 and a delay controller 44. The filter controller 43 reads filter control data F of resonators based on the damper level from the storage device 26. The delay controller 44 reads predetermined delay time data D from a coefficient table in the storage device 26. The delay time data D from the delay controller 44 enables adjustment of a resonant frequency of resonance data output from the resonators, and the filter control data F from the filter controller 43 enables adjustment (suppression) of a resonance level of the resonators.

Moreover, the resonance sound adding device 22 includes the gain controller 45 which controls gains of the amplifiers 32, 39, and 40.

In FIG. 2, items of sound signal data L_In and R_In from the two systems of the left channel and the right channel are added to each other in the adder 31 and amplified by the amplifier 32. An output from the amplifier 32 is input to the first resonator group 33 and the second resonator group 34.

The first and second resonator groups 33 and 34 generate resonance sounds based on the input data, and generate resonance data which imitates a resonance phenomenon between strings of a piano.

Items of output data from the first and second resonator groups 33 and 34 are subjected to tone adjustment by the first and second filters 35 and 36, and then amplified by the amplifiers 39 and 40, respectively. The items of data, which are tone-adjusted and amplified, are added to original items of sound signal data of the two systems (output from the amplifiers 37 and 38) and output.

The first and second filters 35 and 36 are provided with the objective of imitating tone changes and echoes which are owing to a body structure of the piano. The first and second filters 35 and 36 can be realized by combining some of a low-pass filter (LPF), a high-pass filter (HPF), and an all-pass filter. For example, the first filter 35 and the second filter 36 may have a configuration in which the LPF and the HPF are connected in series.

Figure 3:
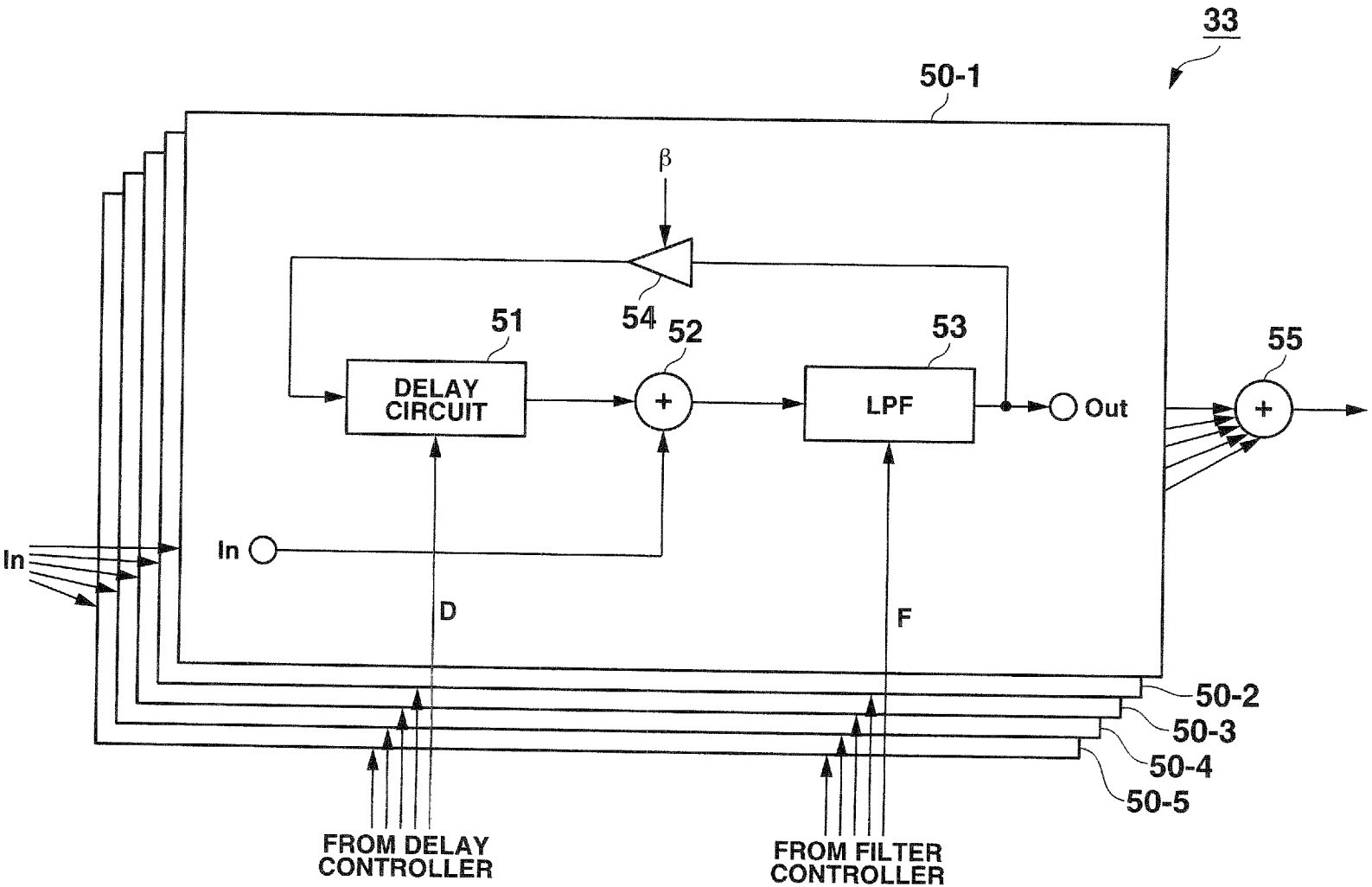
FIG. 3 is a block diagram showing a configuration of a group of resonators according to the embodiment.

FIG. 3 is a block diagram showing a configuration of a group of resonators according to the present embodiment. Since both the first and second resonator groups 33 and 34 have the same configuration as shown in FIG. 3, the first resonator group 33 will he explained as an example.

As shown in FIG. 3, the first resonator group 33 includes resonators 50-1 to 50-5. In the example shown in FIG. 3, the first resonator group 33 includes five resonators 50; however the number of resonators is not limited to 5. For example, the first resonator group 33 may include twelve resonators in accordance with the number of keys constituting one octave.

The first resonator group 33 includes an adder 55 which adds outputs from the resonators 50-1 to 50-5. In the present embodiment, the resonators 50-1 to 50-5 are arranged in parallel, and resonance data is generated by adding outputs from the resonators 50-1 to 50-5. The respective resonators 50-1 to 50-5 imitate resonance vibration of strings of the acoustic piano. When designating any one of the resonators 50-1 to 50-5 rather than a specific one of them, it will be simply referred to as a resonator 50.

As shown in FIG. 3, the resonator 50 includes a delay circuit 51, an adder 52, a low-pass filter (LPF) 53, and an amplifier 54. An input and an output of the delay circuit 51 are connected with each other through the LPF 53 and the amplifier 54, thereby forming a feedback path. This configuration allows a resonance phenomenon of string vibration to be imitated. An input In is applied to the resonance feedback path and subjected to addition at the adder 52, then a resonance sound is generated. It is to be noted that a gain β of the amplifier 54 is set smaller than 1 but close to 1 (e.g., 0.95).

Delay time data D from the delay controller 44 is supplied to the delay circuit 51. The delay time data D determines a delay time of the filter. Adjusting the delay time data D enables control of a resonant frequency of a resonance sound to be generated in the resonator 50. A resonance sound corresponding to a resonant state of a long string can be obtained when the delay time data D that makes a delay time longer is supplied. Moreover, a resonance sound corresponding to a resonant state of a short string can be obtained when the delay time data D that shortens the delay time is supplied.

Filter control data E from the filter controller 43 is supplied to the LPF 53. The filter control data F determines a cutoff frequency of the LPF 53 and can adjust intensity of resonance. In general, when a string is stimulated from the outside and starts vibration, attenuation proceeds quickly when the frequency of the vibration is high; however, the vibration corresponding to a low frequency continues longer. The LPF 53 is provided to imitate such phenomena.

Since a plurality of damper levels are provided as the degree of damping (128 levels in the present embodiment), the degree of damping (damper level) is changed depending on the pressed extent of the damper pedal 18. A change in vibration state of a string can be imitated by using the filter control data F depending on the damper level. In a state in which the damper pedal 18 is released (off state), strings of the piano are pressed by felt equipment called dampers and the strings hardly vibrates in response to external stimulation. However, pressing the damper pedal 18 gradually isolates the dampers from the strings; therefore, the strings come more likely to vibrate and resonate. Such a phenomenon is replicated by using the filter control data F associated with the damper level to change a cutoff frequency of the LPF 53.

A resonant frequency of the resonator according to the present embodiment will now be explained. In the present embodiment, lower resonant frequencies (fL1 to fL5) are supplied to the first resonator group 33, and resonance sounds of lower frequencies are generated. Higher resonant frequencies (fR1 to fR5) are supplied to the second resonator group 34, and resonance sounds of higher frequencies are generated. That is, a maximal value among fL1 to fL5 is smaller than a minimum value among fR1 to fR5. As a result, a resonance sound of a low pitch string is output from the left channel and a resonance sound of a high pitch string is output from the right channel; therefore, a sense of spreading resonance sounds like an actual grand piano can be provided. Furthermore, the resonant frequencies fL1 to fL5 are different from each other, and the resonant frequencies fR1 to fR5 are likewise different from each other.

The delay time D is an inverse number of a resonant frequency f (fL1 to fL5 and fR1 to fR5). Therefore, items of delay time data respectively corresponding to different delay times DL1 (=1/fL1) to DL5 (=1/fL5) are supplied to the delay circuits 51 of the resonators 50-1 to 50-5 in the first resonator group 33. Likewise, items of delay time data respectively corresponding to different delay times DR1 (=1/fR1) to DR5 (=1/fR5) are supplied to the delay circuits of the resonators in the second resonator group 34.

As explained above, in the case where the resonant frequency matches with the pitch of a specific key, resonance is intensified merely when a certain key is struck, and a harsh resonance sound may be generated. Thus, in the present embodiment, the resonant frequencies of resonators are set not to match with a pitch of any key.

Assuming that a frequency of an A4-key is 440 Hz, pitches (frequencies) and cycles of keys in one octave from C3 to B3 are shown in FIG. 4A. In addition, pitches (frequencies) and cycles of keys C4 to B4 in one octave are shown in FIG. 4B.

For example, when a delay time of a given resonator is set to approximately 3.8 ms, a harsh resonance sound is generated when a key of C4 (corresponding cycle is 3.822 ms) is struck.

In the present embodiment, a coefficient table storing delay times as shown in FIG. 5A is saved in the storage device 26 for the resonators 50-1 to 50-5 in the first resonator group 33. Also, a coefficient table storing delay times as shown in FIG. 5B is saved in the storage device 26 for the resonators in the second resonator group 34.

The coefficient table 501 which is shown in FIG. 5A stores delay times (cycles) corresponding to intermediate values between pitches of adjacent keys within C3 to B3, which are depicted in FIG. 4A. Further, the coefficient table 502 which is depicted in FIG. 5B stores delay times (cycles) corresponding to intermediate values between pitches of adjacent keys within C4 to B4, which are depicted in FIG. 4B. In this example, the delay time data D (unit: ms) in the coefficient tables 501 and 502 has the following relationship with respect to a pitch of a key. Note that a frequency (or pitch) corresponding to a pitch name which designates a key is denoted by "Freq(pitch_name)".

$$D=1/(\text{Freq(pitch_name)}+\text{Freq(pitch_name)}*2\hat{}(1/12))*1000$$

In this example, delay time data D corresponds to an inverse number of an intermediate frequency between pitches of keys adjacent to each other.

Alternatively, delay time data D may have the following relationship with respect to a pitch (or frequency) of a key which is denoted by "Freq(pitch_name)".

$$D=(1/(\text{Freq(pitch_name)}\times 1000+1/(\text{Freq(pitch_name)}*2\hat{}(1/12)\times 1000)/2$$

In this example, delay time data D corresponds to an intermediate value between inverse numbers of pitches of keys adjacent to each other.

In the examples shown in FIGS. 5A and 5B, twelve items of delay time data are stored in each of the coefficient tables 501 and 502. However, in practice, it is sufficient to store delay times corresponding to the number of resonators.

In the present embodiment, the first and second resonator groups 33 and 34 respectively include five resonators, by way of example. Therefore, it is sufficient that one coefficient table stores five values selected from the items of delay time data in the coefficient table 501, and the other coefficient table stores also five values selected from the items of delay time data in the coefficient table 502.

FIG. 6A shows another example of a coefficient table storing five values selected from the coefficient table 501 (shown in FIG. 5A), and FIG. 6B shows another example of a coefficient table storing five values selected from the coefficient table 502 (shown in FIG. 5B). The coefficient tables 601 and 602 respectively shown in FIGS. 6A and 6B store the second values, fourth values, sixth values, eighth values, and tenth values of the coefficient tables 501 and 502. The stored values are indexed by DL1 to DL5 in the coefficient table 601 and indexed by DR1 to DR5 in the coefficient table 602.

In the present embodiment, when tuning keeps a standard state (frequency of reference sound A4 takes 440 Hz), coefficient tables 601 and 602 stored in the storage device 26 are utilized. The delay controller 44 acquires delay times from the coefficient table 601, and supplies the delay times DL1 to DL1 from the coefficient table 601 to the resonators 50-1 to 50-5 of the first resonator group 33. Furthermore, the delay controller 44 acquires delay times from the coefficient table 602, and supplies the delay times DR1 to DR5 from the coefficient table 602 to the resonators of the second resonator group 34.

The case in which the pitches (tuning) of keys are changed (pitches are controlled) will be explained later.

The filter control data F will now be explained. In the present embodiment, the cutoff frequency of the LPF 53 is changed in accordance with 128 levels of damping, from level 0 to level 127. The filter control data F on each damper level is stored in the storage device 26 as a filter control data table.

FIG. 7 is a view showing an example of the filter control data table according to the present embodiment. The filter controller 43 reads the filter control data F from the filter control data table 701 in accordance with a degree of damping (damper level) supplied from the CPU 12. The filter controller 43 provides the read filter control data F to the low-pass filters (LPF) 53 in the resonators 50-1 to 50-5 of the first and second resonator groups 33 and 34.

In the example shown in FIG. 7, the filter control data F corresponding to the cutoff frequency of "1 kHz" is supplied to the LPFs 53 when the damper pedal is in an OFF state (damper level is 0). The filter frequency data F corresponding to the cutoff frequency of "5 kHz" is supplied when the damper pedal is fully pressed (damper level is 127). The filter control data F is determined depending on the damper level between the above two levels (0 and 127). The cutoff frequency keeps linearity to the damper level. Two points designated by (damper level: 0, cutoff frequency: 1 kHz) and (damper level: 127, cutoff frequency: 5 kHz) can be located on the "cutoff frequency"-"damper level" line.

Operation of thus configured resonance sound adding device 22 will now be explained hereinafter. When a player of the keyboard instrument operates the keyboard 14 and strikes a key, information of the struck key is transmitted to the CPU 12 from the keyboard 14. The CPU 12 supplies pitch information of the struck key to the sound generator 20. The sound generator 20 reads waveform data from the waveform memory in the storage device 26, and generates and outputs sound signal data based on the pitch of the struck key.

In the case where the damper pedal 18 is being pressed, the CPU 12 supplies a damper level indicative of the pressed state of the damper pedal 18 to the resonance sound adding device 22. It is to be noted that, when the damper pedal 18 is in the OFF state, the CPU 12 supplies a damper level zero indicating that the damper level is off to the resonance sound adding device 22.

As shown in FIG. 2, items of sound signal data "L_In" and "R_In" of the left and right channels are input to the resonance sound adding device 22. The sound signal data of the left channel and the sound signal data of the right channel are added in the adder 31 and supplied to the first and second resonator groups 33 and 34 through the amplifier 32. Furthermore, the sound signal data of the left channel and the sound signal data of the right channel are respectively supplied to the adders 41 and 42 via the amplifiers 37 and 38.

The delay controller 44 reads the delay time data D that is to be supplied to the first resonator group 33 from the coefficient table 601 in the storage device 26. Moreover, the delay controller 44 also reads the delay time data D that is to be supplied to the second resonator group 34 from the coefficient table 602 in the storage device 26.

The filter controller 43 reads predetermined filter control data F from the filter control data table stored in the storage device 26 based on the damper level supplied from the CPU 12.

In the first resonator group 33, the respective resonators (five resonators 50-1 to 50-5 in the present embodiment) delay signals based on the delay times D (DL1 to DL5) supplied from the delay controller 44 and perform filtering processing on the signals in accordance with the filter control data F. Respective items of data output from the resonators are added in the adder 55, output from the first resonator group 33, and supplied to the first filter 35.

Likewise in the second resonator group 34, the respective resonators (five resonators in the present embodiment) delay signals based on the delay time data D (DR1 to DR5) supplied from the delay controller 44 and perform filtering processing on the signals in accordance with the filter control data F. Respective items of data output from the resonators are added in the adder 55, output from the second resonator group 34, and supplied to the second filter 36.

An output from the first filter 35 passes through the amplifier 39, and then is added to the sound signal data of the left channel in the adder 41 to be output. In addition, an output from the second filter 36 is added to the sound signal data of the right channel in the adder 42 and output.

As described above, for each of the left channel and the right channel, the sound signal data having an added resonance sound which bases on delay time data and the damper level of the damper pedal 18 can be obtained. The sound signal data having the resonance sound added thereto is supplied to the sound system 24. The sound system 24 performs digital-to-analog conversion and amplification on the sound signal data, and generates an acoustic signal based on the sound signal data. The generated signal is output from the speaker.

There may be a case in which operation of an operation member in the group of operation members 16 changes tuning of the keyboard instrument 10. In the present embodiment, a reference sound is set to A4 and the pitch (frequency) of the reference sound A4 is set to 440 Hz by way of example. A player can operate the operation member to change the pitch of the reference sound within a predetermined range. The CPU 12 also changes the pitch (frequency) of each key in accordance with the change in tuning and supplies pitch information indicative of a changed frequency to the sound generator 20.

An example where the reference sound A4 is changed from 440 to 450 Hz will now be considered. FIG. 8A is a table showing pitches (frequencies) and cycles of the keys C4 to B4 when A4 is 450 Hz.

As shown in FIG. 8A, when A4 is 450 Hz, a cycle corresponding to each key is very close to each delay time stored in the coefficient table shown in FIG. 5B. For example, a cycle of C4 is 3.737 ms, whereas a delay time corresponding to an intermediate value of C4 and C#4 is 3.712 ms, and these values are very close to each other. Therefore, in a case where the delay time corresponding to the intermediate value of C4 and C#4 is supplied as delay time data of a resonator, a resonance phenomenon may highly possibly occur to generate a harsh resonance sound when a player strikes the key C4.

Thus, in the present embodiment, when tuning is changed, delay time data that does not match with cycles corresponding to pitches of any keys is calculated, and a coefficient table storing the calculated delay time data is saved in the storage device 26.

Figure 9:
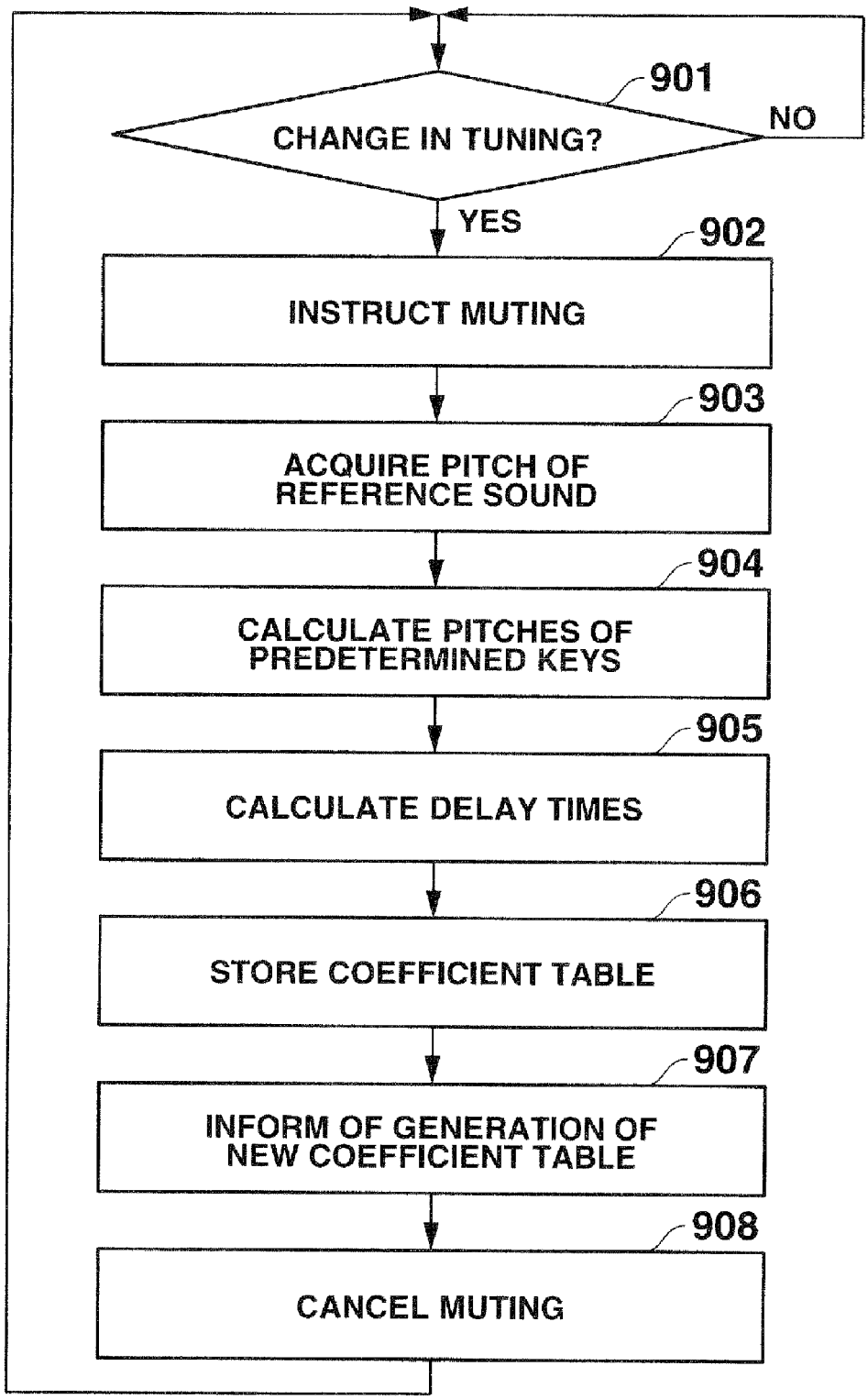
FIG. 9 is a flowchart showing an example of calculation processing for a new coefficient table according to the embodiment.

FIG. 9 is a flowchart showing an example of calculation processing for the new coefficient table according to the present embodiment. As shown in FIG. 9, when the CPU 12 determines that turning is changed by an operation of an operation member (Yes in step 901), the CPU 12 instructs the resonance sound adding device 22 to mute a resonance sound (step 902). Upon accepting the muting instruction, the gain controller 45 in the resonance sound adding device 22 sets gains of the amplifiers 32, 39, and 40 to zero. As a result, data corresponding to silence state is supplied to the first and second resonator groups 33 and 34, thereby initializing the resonators in the first and second resonator groups 33 and 34. Further, an output from the first filter 35 and an output from the second filter 36 are set to zero; therefore, the resonance sound adding device 22 outputs merely sound signal data supplied through the amplifiers 37 and 38.

As a result, immediately after tuning is changed, resonance data is not added to the sound signal data, and the sound signal data alone is output. Therefore, it can be avoided that using the original delay time data causes a resonance phenomenon generating a harsh resonance sound.

Then, the CPU 12 acquires the pitch of the reference sound involved with the change in tuning (step 903). For example, acquiring the pitch of the reference sound can be realized by calculating the pitch (frequency) of a new reference sound based on how the operation member is operated. In the foregoing example, the pitch of the new reference sound is 450 Hz.

The CPU 12 calculates pitches of predetermined keys required to calculate delay times that should be stored in the coefficient tables (step 904). For example, when such coefficient tables as shown in FIGS. 6A and 6B are being used, the CPU 12 calculates new pitches involved with the tuning change for C#3 to A#3 and C#4 to A#4.

Subsequently, the CPU 12 calculates delay times that should be stored in the coefficient table based on pitches adjacent to each other and calculated in step 904 (step 905).

As explained above, each delay time can be calculated based on the following expression. The "adjacent_pitch_name" denotes a pitch name of a key adjacent to the key that is corresponding to "pitch_name."

$$D=1/((\text{Freq}(\text{pitch_name})+\text{Freq}(\text{adjacent_pitch_name}))/2)*1000$$

The CPU 12 stores calculated delay time data into the coefficient table in the storage device 26 (step 906). Values in the coefficient table in the storage device 26 may be rewritten. Alternatively, a new coefficient table different from the original coefficient table may be generated in the storage device 26.

The CPU 12 informs the resonance sound adding device 22 of a fact that the new coefficient table is generated (step 907). For example, in step 907, an address of the new coefficient table in the storage device 26 is informed. In the case where the values in the coefficient table are rewritten, step 907 may be omitted. The delay controller 44 in the resonance sound adding device 22 can read the delay time data from the new coefficient table in accordance with the information.

Then, the CPU 12 instructs the resonance sound adding device 22 to cancel muting (step 908). Upon accepting the muting canceling instruction, the gain controller 45 in the resonance sound adding device 22 restores the gains of the amplifiers 32, 39, and 40.

Since the gain of the amplifier 32 has been set to zero and the first and second resonator groups 33 and 34 have been initialized, a harsh resonance sound is not generated even though the gains of the amplifiers 32, 39, and 40 are restored. Further, since the delay controller 44 can read the delay times from the coefficient table having the appropriate delay times stored therein, an unnecessary resonance phenomenon does not occur.

FIG. 8B is a view showing each cycle (delay time) corresponding to an inverse number of an intermediate value between a pitch depicted in FIG. 8A and a pitch adjacent thereto. In the present embodiment, for example, the storage device 26 saves a coefficient table storing respective items of delay time data denoted by reference numbers 811 to 815.

Figure 10A:
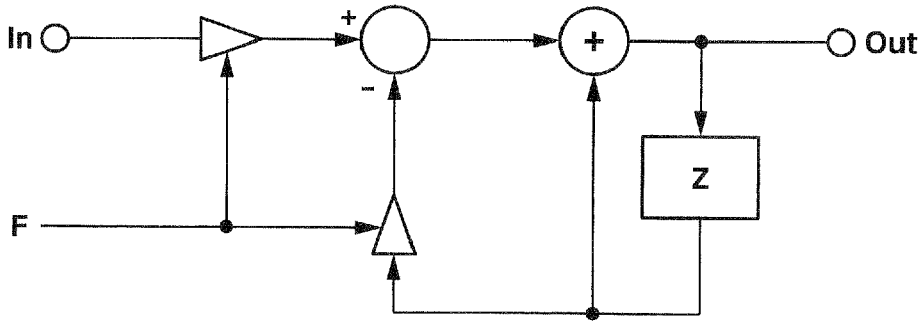
FIGS. 10A, 10B and 10C are views showing filters of the resonance sound adding device according to the embodiment.
Figure 10B:
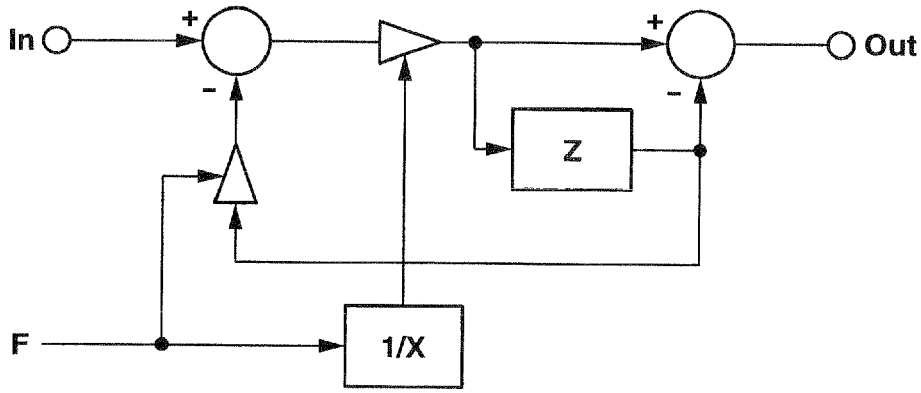
Figure 10C:
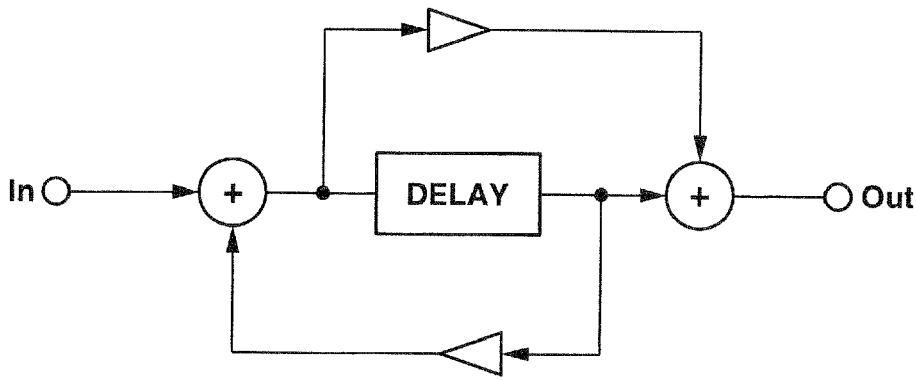

FIGS. 10A, 10B and 10C are views showing examples of filters utilized in the resonance sound adding device 22 according to the present embodiment. FIG. 10A is a view showing an example of an LPF used in the first or second filter 35 or 36 (in FIG. 2), or the LPF 53 (FIG. 3) in the resonator 50. A block denoted by "z" in FIG. 10A is a delay unit that delays data for one sampling cycle. Data input is represented as "In" and data output is represented as "Out". Furthermore, a signal of a cutoff frequency of the filter is input to "F". In the LPF 53 of the resonator 50, the filter control data F from the filter controller 43 corresponds to a signal "F" in FIG. 10A. In any other filter, a signal "F" of a cutoff frequency is constant.

FIG. 10B is a view showing an example of an HPF used in the first filter 35 or the second filter 36. Similarly to FIG. 10A, a block denoted by "z" is a delay unit that delays data for one sampling cycle. Data input is represented as "In" and data output is represented as "Out". Moreover, a signal of a cutoff frequency of the filter is input to "F," and a block denoted by "1/x" inverts a signal F of the cutoff frequency as "1/F".

FIG. 10C is a view showing an example of an all-pass filter. The all-pass filter can be likewise used as a constituent element of the first filter 35 or the second filter 36. In FIG. 10C, a block denoted by "Delay" is a delay unit that delays input data for a predetermined time. Data input is represented as "In" and data output is represented as "Out." The all-pass filter causes an effect of generating an acoustic echo having many delay components without changing frequency characteristics. Therefore, using the all-pass filter enables generation of a signal simulating a state of echoes inside the body of the piano.

According to the present embodiment, since items of the delay time data stored in the coefficient table do not match with any cycles corresponding to pitches of the keys, it is possible to avoid occurrence of a resonance phenomenon resulting in generation of a harsh resonance sound when a specific key is struck. Accordingly, when any key is struck, an appropriate resonance sound is added to the sound signal data.

In the present embodiment, provided are the first resonator group 33 that generates the first resonance data based on the sound signal data for the left channel and the second resonator group 34 that generates the second resonance data based on the sound signal data for the right channel. Moreover, delay times indicated by items of the delay time data for respective resonators in the first resonator group 33 are larger than delay times indicated by items of the delay time data for respective resonators in the second resonator group 34. As a result, a resonance sound having a lower frequency is added to a sound signal of the left channel, and a resonance sound having a higher frequency is added to a sound signal of the right channel. Therefore, a sense of spreading resonance sounds can be provided.

Further in the present embodiment, the damper level rises as the pressed extent of the damper pedal 18 (damper level) increases. The filter control signal is generated based on the damper level, that is, a cutoff frequency increases as the damper level rises. As a result, an intensity of resonance can be appropriately adjusted in accordance with the pressed state of the damper level.

Furthermore in the present embodiment, when pitches of keys (tuning) are changed, new delay time data is calculated in accordance with a degree of the pitch-change. The newly calculated items of delay data do not match with any cycles corresponding to the changed pitches of the keys. As a result, even though the tuning is changed, occurrence of a resonance phenomenon which results in generation of a harsh resonance sound responsible for striking a specific key can be avoided.

Moreover, in the present embodiment, provided is the gain controller 45 that adjusts a gain of sound signal data input to the resonator groups 33 and 34, and adjusts a gain of resonance data to be added to the sound signal data. In response to a change in the pitches of the keys, the gain controller 45 makes a gain of the sound signal data which is to be input to the resonator groups into zero, and makes gains of the resonance data which is to be added to the sound signal data into zero; and the gains are restored when new delay time data is generated.

Making the gain of the sound signal data, which is to be input to the resonator groups, into zero in response to a change in the pitches of the keys enables initialization of resonators. Moreover, making the gains of the resonance data, which is to be added to the sound signal data, into zero can prevent harsh resonance data from being added to the sound signal data with the change in pitch of the key. In addition, when new delay data is generated, harsh resonance data is not added to the sound signal data because resonators have been initialized even though the gains are restored.

A second embodiment according to the present invention will now be explained. According to the second embodiment, an HPF is subsequently connected to an LPF in a resonator. In addition, a cutoff frequency of the HPF is controlled depending on an output level of the HPF.

Figure 11:
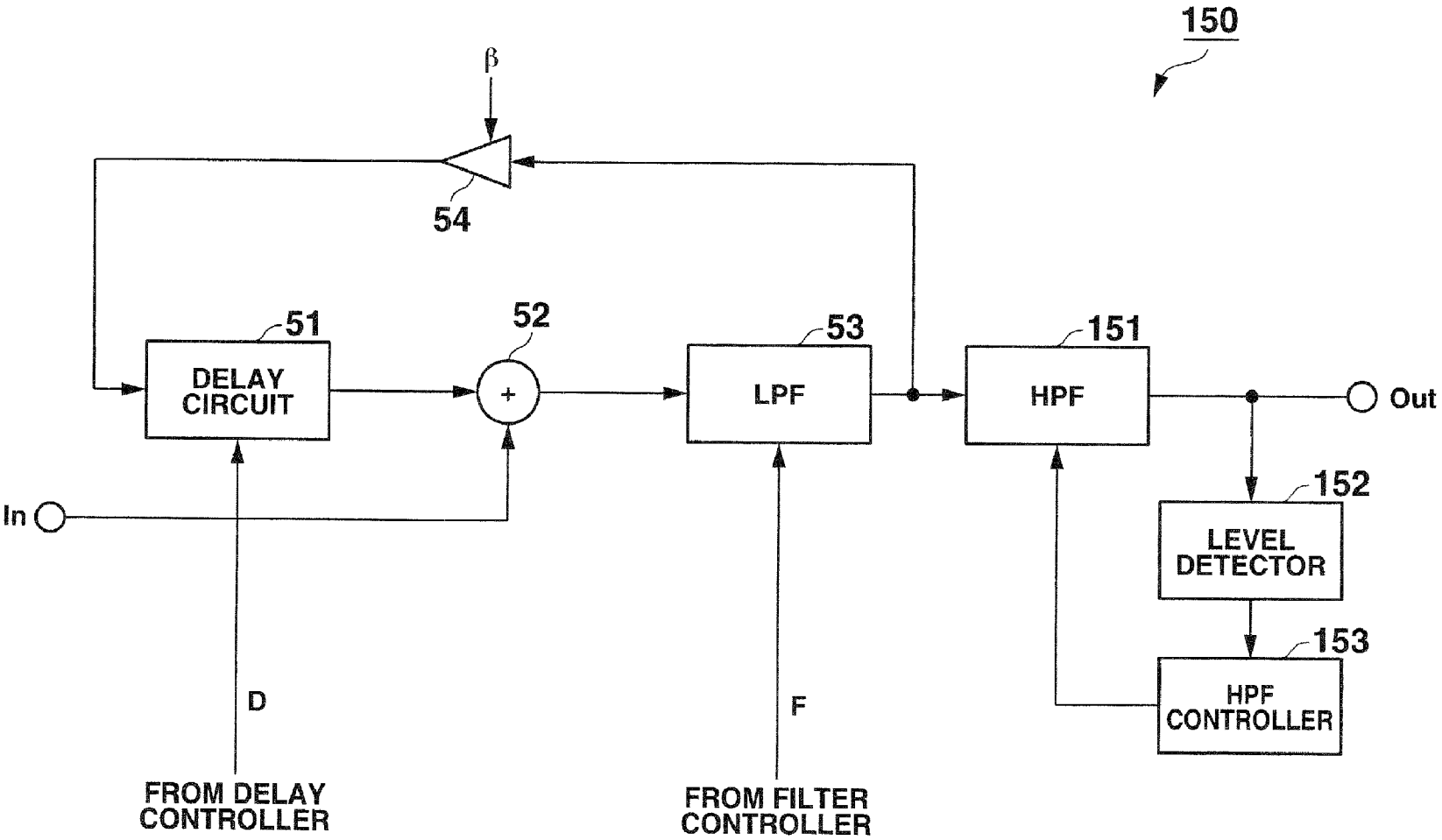
FIG. 11 is a block diagram showing a configuration of a resonator according to a second embodiment.

FIG. 11 is a block diagram showing a configuration of a resonator according to the second embodiment. Similarly to the first embodiment, each of the resonator groups (first and second resonator groups) according to the second embodiment includes predetermined number (e.g., five) of resonators 150 depicted in FIG. 11. Outputs from the resonators are added to each other in an adder to be output.

As shown in FIG. 11, a resonator 150 includes a delay circuit 51, an adder 52, a low-pass filter (LPF) 53, an amplifier 54, an HPF 151, a level detector 152, and an HPF controller 153. In FIG. 11, similar elements to the elements in the resonator 50 of the first embodiment are denoted by the same reference numbers as the first embodiment.

The level detector 152 detects an output level (amplitude) of the HPF 151. The HPF controller 153 outputs a filter control signal for controlling the HPF 151 in such a manner that a cutoff frequency increases as an amplitude level rises. For example, the HPF controller 153 may include a coefficient table storing such values that the cutoff frequency linearly increases as the amplitude level rises. The HPF controller 153 may output the filter control signal that is extracted from the coefficient table corresponding to the input amplitude level.

According to the second embodiment, even when a frequency of a main component in a sound signal is close to or matches with a resonant frequency of a resonator and a level in the resonator rises, the HPF having the appropriately controlled cutoff frequency removes components of a low-frequency band. Therefore, a component that strongly resonates with a sound signal in a low-frequency band can be reduced while leaving a resonance sound in a high-frequency band.

Figure 12:
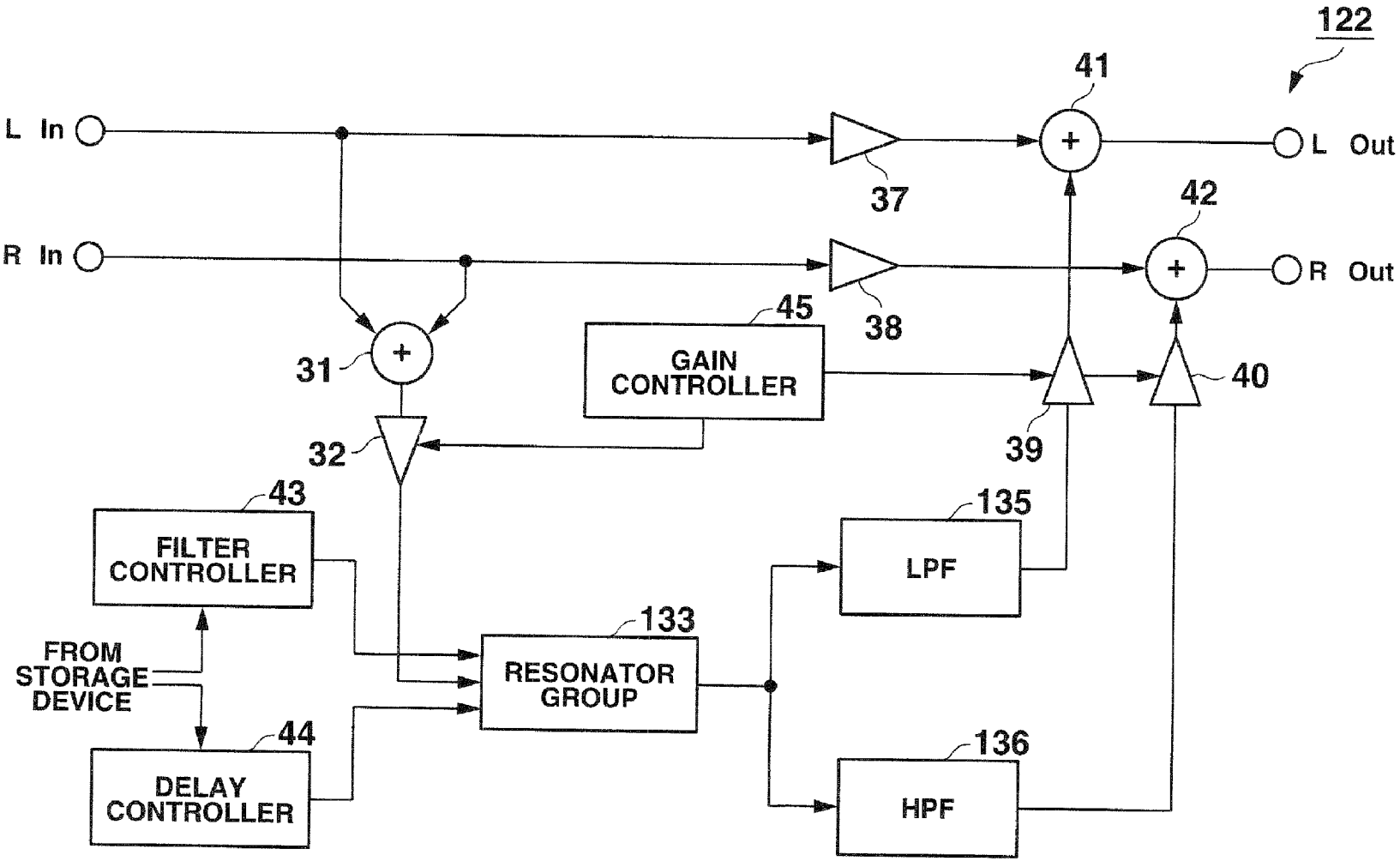
FIG. 12 is a block diagram showing a configuration of a resonance sound adding device according to a third embodiment.

A third embodiment according to the present invention will now be explained. The groups of resonators are respectively provided for the left and right channels in the first embodiment; however, a single resonator group is provided in the third embodiment. FIG. 12 is a block diagram showing a structure of a resonance sound adding device according to the third embodiment of the present invention.

As shown in FIG. 12, a resonance sound adding device 122 according to the present embodiment includes an adder 31, an amplifier 32, a resonator group 133, an LPF 135, an HPF 136, amplifiers 37, 38, 39 and 40, and adders 40 and 42. The adder 31 adds sound signal data L_In of a left channel (L. ch) and sound signal data R_In of a right channel (R. ch). The amplifier 32 amplifies an output from the adder 31. The resonator group 133 generates resonance data. The LPF 135 performs low-pass filtering processing on the resonance data output from the resonator group 133. The HPF 136 performs high-pass filtering processing on resonance data output from the resonator group 133. The amplifier 37 amplifies the sound signal data of the left channel. The amplifier 38 amplifies the sound signal data of the right channel. The amplifier 39 amplifies an output from the LPF 135. The amplifier 40 amplifies an output from the HPF 136. The adder 41 adds an output from the amplifier 37 to an output from the amplifier 39, and outputs sound signal data L_Out of the left channel containing a resonance sound is output. The adder 42 adds an output from the amplifier 38 to an output from the amplifier 40, and sound signal data R_Out of the right channel containing a resonance sound is output.

Further, the resonance sound adding device 122 includes a filter controller 43, a delay controller 44 and a gain controller 45.

In FIG. 12, the same elements as in the resonance sound adding device 22 of the FIG. 2 are denoted by the same reference numbers. Furthermore, the resonator group 133 includes the same structure as the first resonator group 33 of the first embodiment.

In the third embodiment, as shown in FIG. 12, items of the sound signal data of the left channel and the right channel "L_In" and "R_In" are input to the resonance sound adding device 22. The sound signal data of the left channel is added to the sound signal data of the right channel in the adder 31, and the data subjected to the addition is supplied to the resonator group 133 through the amplifier 32. Moreover, the sound signal data of the left channel and the sound signal data of the right channel are supplied to the adders 41 and 42 through the amplifiers 37 and 38, respectively.

The delay controller 44 reads delay time data D which is to be supplied to the resonator group 133 from a coefficient table in a storage device 26. The filter controller 43 reads predetermined filter control data F from a filter control data table stored in the storage device 26 based on a damper level supplied from the CPU 12.

In the resonator group 133, each of resonators (five resonators are provided in the present embodiment) delays a signal based on the delay time data D supplied from the delay controller 44 and performs filtering processing on the signal in accordance with the filter control data F. The items of data output from the resonators are added at the adder 55, and the resultant data is output from the resonator group 133.

An output from the resonator group 133 is supplied to the LPF 135 and the HPF 136. The LPF 135 lets components of the resonance sound which are lower than a predetermined cutoff frequency pass therethrough. The HPF 136 lets component of the resonance sound which are higher than another predetermined cutoff frequency pass therethrough.

An output from the LPF 135 passes through the amplifier 38, and then is added to the sound signal data of the left channel in the adder 41 to be output. In addition, an output from the HPF 136 is added to the sound signal data of the right channel in the adder 42 to be output.

According to the third embodiment, by utilizing the LPF 135 and the HPF 136, the components of the resonance sound corresponding to lower frequencies are added to the sound signal of the left channel, and the components of the resonance sound corresponding to higher frequencies are added to the sound signal of the right channel. As a result, even one resonator group can provide a widely spreading resonance sound.

A fourth embodiment according to the present invention will now be explained. In the fourth embodiment, a coefficient table stored in a storage device 26 includes more items of delay time data than the number of resonators. The delay controller 44 reads out given items of delay time data from the coefficient table. The items of delay time data are supplied to the resonators.

In the fourth embodiment, items of delay time data to be selected from the coefficient table are changed based on tonality data. The tonality data indicates tonality of music included in demonstration data to be played in demonstration performance, or tonality input by a player operating an operation member in the group of operation members 16.

FIG. 13 is a view showing an example of a coefficient table and a coefficient selection table for a first resonator group 33 according to the fourth embodiment. In FIG. 13, a table 1300 includes a portion denoted by reference number 1301 as the coefficient table and a portion designated by reference number 1302 as the coefficient selection table, for descriptive purposes.

The coefficient table shown in FIG. 13 is similar to the coefficient table depicted in FIG. 5A. That is, the coefficient table 1301 stores delay times (cycles) corresponding to intermediate pitches between adjacent keys from C3 to B3. Although not shown, a coefficient table for a second resonator group 34 is similar to the coefficient table shown in FIG. 5B.

The coefficient selection table stores selection information to select or not to select items of information designating the items of the delay time data (e.g., DL1 to DL12 in FIG. 13) for respective tonality. For example, in C major or A minor (C (Am)), items DL1, DL3, DL5, DL8, and DL10 are to be selected.

According to the coefficient selection table of the fourth embodiment, for each tonality, delay time data corresponding to resonant frequencies between the pitches of sounds corresponding to I, II, III, V, or VI and the pitches of adjacent keys are selected. In each tonality, sounds constituting a scale, especially I, II, III, V, and VI are frequently used. Therefore, selecting resonant frequencies which are close to some extent to the pitches of the above sounds makes it possible to generate a further appropriate resonance sound, though the selected frequencies are different from the pitches of the sounds.

Figure 14:
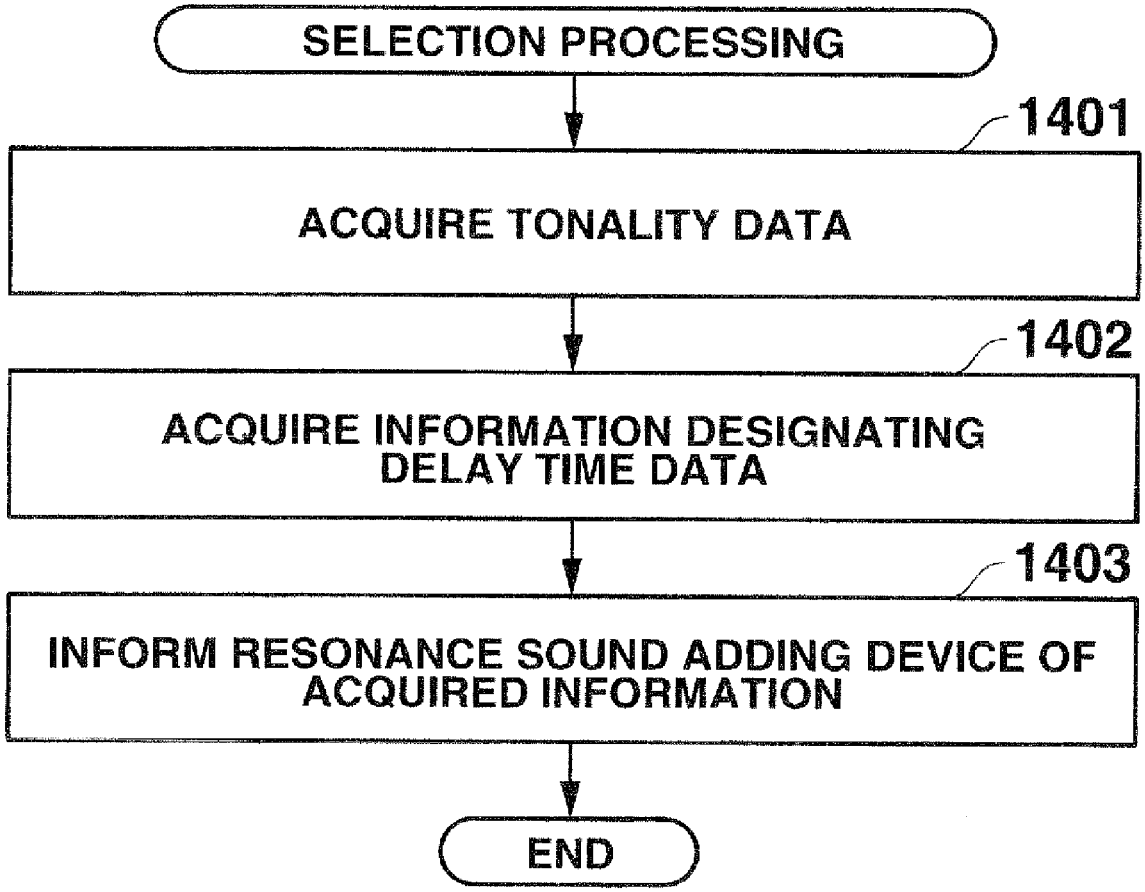
FIG. 14 is a flowchart showing an example of selection processing associated with the coefficient selection table according to the forth embodiment.

FIG. 14 is a flowchart showing an example of selection processing associated with the coefficient selection table according to the present embodiment. As shown in FIG. 14, a CPU 12 acquires tonality data based on an operation made by a player with an operation member of the group of operation members 16 or tonality data contained in demonstration data of music stored in the storage device 26 (step 1401).

Then, the CPU 12 acquires information designating delay time data from the coefficient selection table based on the acquired tonality data (step 1402), and informs the delay controller 44 in a resonance sound adding device 22 of the acquired information designating delay time data (step 1403).

The delay controller 44 reads predetermined items of the delay time data from the coefficient table stored in the storage device 26 based on the provided information designating the delay time data, and provide the items of the delay time data for resonators.

According to the fourth embodiment, the coefficient table includes more items of delay time data than the number of the resonators. The delay controller 44 reads different items of the delay time data corresponding to the number of the resonators from the coefficient table in accordance with the tonality data indicative of tonality of music to be played. Therefore, an appropriate resonance can be added in accordance with tonality of music to be performed.

Moreover, according to the fourth embodiment, the coefficient selection table stores information for designating items of delay time data stored in a coefficient table, for each tonality data. Accordingly, appropriate items of delay time data can be readily selected for each tonality without calculation.

The present invention can be modified in many ways within the scope of the present invention written in claims without being restricted to the foregoing embodiments and such modifications are also included in the scope of the invention.

For example, in the foregoing embodiments, an inverse number of an intermediate value between pitches of keys adjacent to each other or an intermediate value of inverse numbers of pitches of keys adjacent to each other is adopted as the delay time data, and such delay time data is stored in the coefficient table. However, the delay time data is not restricted thereto. A value that is ¼ higher than a pitch of a key may be adopted. In this case, the delay time data D (unit: ms) stored in the coefficient table has the following relationship with respect to a frequency (pitch) (unit: Hz) of a key designated by a "pitch_name".

$$D=1/(\mathrm{Freq}(\mathrm{pitch_name})*2\hat{}(1/24))\times 1000$$

Provided the delay time data does not match with a cycle corresponding to the pitch of any key, any other delay time data, which corresponds to a cycle of a pitch other than a ¼ sound, may be adopted.

In the present embodiment, pitches of keys conform to equal temperament; however, the present invention can be likewise applied to a case where pitches of keys conform to other temperaments, e.g., stretch tuning wherein pitches of low sounds become further lower and pitches of high sounds become further higher, a Werckemeister temperament, or meantone system. In such a case, it is sufficient that the coefficient table of the storage device stores delay time data that does not match any cycles corresponding to pitches of keys. Alternatively, it is also enough that, when a player operates an operation member in the group of operation members 16 to select the temperament, the CPU 12 generates delay time data that does not match with any cycles corresponding to pitches of keys conforming to a selected temperament, and stores the generated data in the coefficient table.

In the first embodiment, the coefficient table may store more items of delay time data than the number of the resonators. The delay controller 44 may read as many different items of delay time data as the number of the resonators from the coefficient table. The delay controller 44 may randomly read items of the delay time data. Alternatively, the delay controller 44 may read items of the delay time data at fixed intervals, for example.

In the fourth embodiment, the CPU 12 makes reference to the coefficient selection table to inform the delay controller 44 of information designating items of the delay time data which are to be read by the delay controller 44. However, the CPU 12 may select delay time data corresponding to a cycle between a pitch constituting a scale of tonality data and a pitch adjacent thereto based on the tonality data without using the coefficient selection table.

What is claimed is:

1. A resonance sound adding apparatus for a keyboard instrument, comprising:

a resonator group comprising resonators and a first adder, the resonators generating resonance sound data of given resonant frequencies based on sound signal data corresponding to a pitch of a key which is struck, each of the resonators including a delay circuit configured to delay an input based on delay time data indicating a delay time, a second adder configured to add an output from the delay circuit to input sound signal data, and a first low-pass filter configured to receive an output from the second adder and to perform low-pass filtering by a cutoff frequency depending on a filter control signal on the output from the second adder, and an output from the first low-pass filter inputting to the delay circuit, and the first adder adding outputs from the resonators;

a third adder configured to add the sound signal data and an output from the resonator group;

a storage device configured to store a coefficient table containing delay time data to be provided to each of the resonators; and a delay controller configured to read different items of the delay time data from the coefficient table and supply the different items of the delay time data to the resonators;

wherein each of the items of the delay time data corresponds to an intermediate value between pitches of two adjacent keys of the keyboard, and does not match with frequencies corresponding to pitches of keys of the keyboard instrument.

2. The resonance sound adding apparatus according to claim 1, further comprising a filter controller configured to generate the filter control signal so that the cutoff frequency increases as a damper level rises, the damper level indicating a degree of pressing of a damper pedal, and the damper level increasing as the degree of pressing of the damper pedal rises, wherein the filter control signal generated by the filter controller is supplied to the first low-pass filter.

3. The resonance sound adding apparatus according to claim 1, wherein the sound signal data includes sound signal data for a left channel and sound signal data for a right channel;

the resonator group includes a first resonator group which generates first resonance sound data based on the sound signal data for the left channel and a second resonator group which generates second resonance sound data based on the sound signal data for the right channel;

the coefficient table includes first items of delay time data for resonators of the first resonator group and second items of delay time data for resonators of the second resonator group; and delay times indicated by the first items of delay time data are larger than delay times indicated by the second items of delay time data.

4. The resonance sound adding apparatus according to claim 1, wherein the sound signal data includes sound signal data for a left channel and sound signal data for a right channel; and the resonance sound adding apparatus further comprising:

a second low-pass filter configured to receive an output from the resonator group and to perform low-pass filtering on the output from the resonator group by a first given cutoff frequency;

a high-pass filter configured to receive an output from the resonator group and to perform high-pass filtering on the output from the resonator group by a second given cutoff frequency;

a fourth adder configured to add an output from the second low-pass filter to the sound signal data for the left channel; and a fifth adder configured to add an output from the high-pass filter to the sound signal data for the right channel.

5. The resonance sound adding apparatus according to claim 1, further comprising a table generator configured to calculate, in response to change of pitches of the keys, new delay time data depending on a degree of the change of the pitches and to generate a coefficient table for storing the new delay time data.

6. The resonance sound adding apparatus according to claim 5, further comprising a gain controller configured to adjust a gain of the sound signal data inputting to the resonator group and to adjust a gain of resonance sound data to be added to the sound signal data, and wherein the gain controller makes the gain of the sound signal data inputting to the resonator group and the gain of resonance sound data to be added to the sound signal data to be zero in response to the change of the pitches, and the gain controller restores the gains when the table generator generates the coefficient table for storing the new delay time data.

7. The resonance data adding apparatus according to claim 1, wherein each of the resonators further comprises:

a high-pass filter configure to receive an output from the first low-pass filter and to perform high-pass filtering on the output from the first low-pass filter;

a level detector configured to detect a level of an output from the high-pass filter; and a high-pass filter controller configured to generate a filter control signal for the high-pass filter based on the level detected by the level detector so that a cutoff frequency of the high-pass filter increases as the level detected by the level detector rises, and wherein an output from the high-pass filter is output as an output of each of the resonators.

8. The resonance sound adding apparatus according to claim 1, wherein the coefficient table contains more items of the delay time data than the number of the resonators, and the delay controller reads as many different items of the delay time data as the number of the resonators from the coefficient table, in accordance with tonality data which indicates tonality of music to be played.

9. The resonance sound adding apparatus according to claim 8, wherein:

the storage device stores a coefficient selection table containing information designating delay time data in the coefficient table for each tonality; and the delay controller reads items of the delay time data from the coefficient table based on the information designating the delay time data in the coefficient selection table in accordance with the tonality of the music to be played.

* * * * *